United States Patent [19]

Tuomi

[11] 4,005,556

[45] Feb. 1, 1977

[54] LIGHTWEIGHT TRUSS-FRAMED HOUSE

[75] Inventor: Roger L. Tuomi, Madison, Wis.

[73] Assignee: The United States of America as represented by the Secretary of Agriculture, Washington, D.C.

[22] Filed: Sept. 19, 1975

[21] Appl. No.: 615,016

Related U.S. Application Data

[63] Continuation-in-part of Ser. No. 509,610, Sept. 26, 1974, abandoned.

[52] U.S. Cl. ..... 52/93; 52/299; 52/650; 52/745

[51] Int. Cl.[2] ..... E04B 7/02; E04B 7/12

[58] Field of Search ..... 52/90, 92, 93, 79, 127, 52/299, 745, 650, 741

[56] References Cited

UNITED STATES PATENTS 3,156,018 11/1964 Slayter ..... 52/90

3,662,502 5/1972 Wright ..... 52/93

*Primary Examiner*—J. Karl Bell

*Attorney, Agent, or Firm*—M. Howard Silverstein; David G. McConnell

[57] ABSTRACT

A house erected with preassembled frames, with each frame including a floor truss system, trussed rafter system, and conventional wall studs, which are integrally joined together into a rigid framework capable of supporting loads over long spans without intermediate supports. Each of the components resists imposed loads applied at any point in the frame. The preassembled frames are individually tilted up onto the sill plates at the construction site. Successive frames are erected and structural sheathing is attached thereto until the structure is completed. The structural superiority of the integral truss assembly, both in strength and stiffness, is amenable by structural analysis.

7 Claims, 5 Drawing Figures

LIGHTWEIGHT TRUSS-FRAMED HOUSE

This is a continuation-in-part application of my copending Ser. No. 509,610 filed on Sept. 26, 1974 now abandoned.

BACKGROUND OF THE INVENTION

1. Field of the Invention

The invention relates generally to the field of static structures and more particularly to a preassembled rigid framework combining floor truss, wall, and trussed roof components into a rigid structure for light construction.

2. Description of the Prior Art

Use of trussed rafters had led to improved efficiency in roof systems while open web joists are commonly used in constructing industrial buildings. Conventional light-frame construction involves piece-by-piece onsite assembly of the various members. This involves a high degree of layout and carpentry skills involving knowledge of construction details, nails, sizes, and schedules. Work progresses in stages from floor to roof. Interior framing and bearing partitions are constructed simultaneously with exterior framing. The roof is eventually constructed and sheathed but considerable time and field labor are expended before the house is finally enclosed so that work can continue unhindered by wind, rain, or snow. Conventionally, it is then necessary to go back and cut or drill holes for electric lines, registers, etc. Duct work, plumbing, and other appurtenances are hung from the floor joists and the basement ceiling is cluttered and unsightly.

With the lightweight truss framing contemplated by the invention all frame connections would be made inplant under controlled conditions. The floors, walls, and roof would be erected onsite as an assembly by tilt-up construction methods into a unitized framework enabling the house to be quickly enclosed. Lesser skilled labor would be needed and protection from the elements is achieved in a short period of time. Ducts and other utilities can be run through passageways in the open webs of trusses thus providing a clean unobstructed basement. When box beam floor systems are used, web openings can be designed and cut in areas of low shear, thus providing passageways for utilities. Electric circuits and plumbing service lines can branch up between frames eliminating the need for drilling or dapping wall studs.

Another area involving a serious national resource waste and personal economic hardship is hurricane-caused house damage and other damage caused by natural forces. A major weakness in most conventional construction lies in the connections between foundations, floors, walls, and roofs. Because the conventional house is not positively tied together, roofs are blown off or entire houses are displaced from their foundations. The light-weight truss-framed system disclosed provides positive connections having far greater resistance to natural disasters. To the inventor's knowledge, no known effort has ever been made to tie the roof truss system, stud walls, and floor truss system together into a composite structure or unitized framework.

SUMMARY OF THE INVENTION

Herein disclosed is a lightweight house erected with flat preassembled frames, each consisting of a floor truss system, conventional wall studs, and a roof truss system tied together by rigid joints into a structurally superior assembly in which every element resists load forces applied at any point. The rigid joints are secured using conventional truss plates, plywood gusset plates, or any fasteners capable of transmitting moment, shear, and axial forces between members.

It is contemplated that with lightweight trussed framing all the connections for an individual assembled section would be made in a plant under controlled conditions. Each assembly, being relatively light in weight (approximately 250 pounds), can be erected on the building site using tilt-up construction methods without need for lifting equipment. The floors, walls, and roof would go up as a unit and the house can be quickly enclosed. Floor, roof, and wall coverings are applied in a conventional manner.

Since intermediate supports are done away with, columns, beams, and bearing partitions are eliminated. The clear spaces between exterior walls provides great flexibility for interior planning and layout, both in the house proper and basement area. Additionally, the disclosed framing system requires no sole plates thereby enabling service leads to be run upstairs directly in the wall cavity between studs without the need for drilling and cutting.

Producers of trussed rafters presently have the equipment and facilities to mass produce lightweight trussed frames. Equally important, truss plants are now strategically located in all major cities throughout the United States making transportation an easy matter. Other forms of industrialized houses, particularly module construction, have experienced transportation difficulties due to the shear volume of components. With the invention, all of the assemblies for a 40-foot-long house can be nested into a bundle less than 3 feet wide.

Accordingly, an object of the invention is a truss framing system that better resists imposed forces and is capable of supporting loads over long spans without intermediate support. Another object of the invention is a framing system that allows quicker onsite construction without the need for high degree layout and construction detail skills. A final object of the invention is a building that is constructed using less raw materials, is quickly assembled, and is less costly than conventional buildings.

BRIEF DESCRIPTION OF THE DRAWING

The invention is illustrated in the accompanying drawings in which.

DESCRIPTION OF THE PREFERRED EMBODIMENTS

Figure 2:
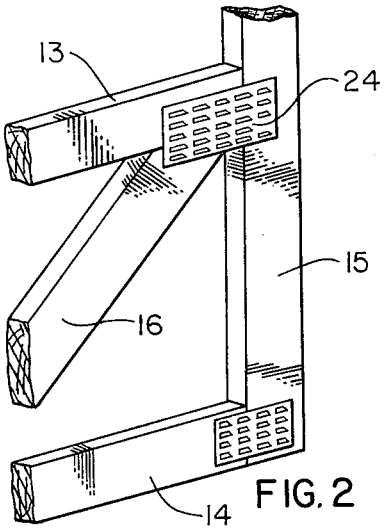
FIG. 2 is a partial isometric view showing the interconnections of a wall stud, top and bottom floor chords, and a web member.
Figure 1:
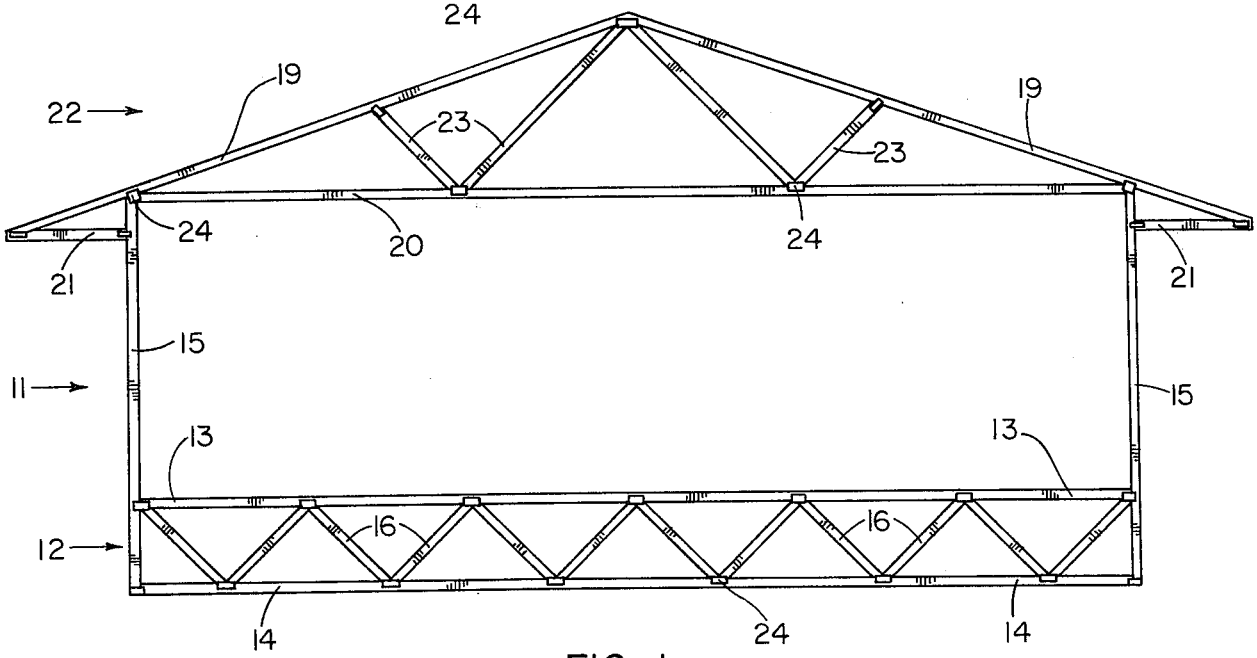
FIG. 1 is an elevation view of a frame member.

FIG. 1 illustrates an assembled frame member 11. This frame includes a floor truss system 12, here with a top floor chord 13 and a bottom floor chord 14 extending between and connected at their ends to the vertical wall studs 15, with the bottom floor chord being adjacent to the studs' lower ends. These chords are parallel to each other and in the same vertical plane. Also illustrated are supporting web members 16 which extend between and connect to the top and bottom floor chords. These web members can be constructed in various configurations such as the Warren Truss (depicted in FIGS. 1 and 5), Pratt Truss, or K Truss. The connections between the floor chords, a supporting web, and a wall stud are shown in detail in FIG. 2.

Figure 3:
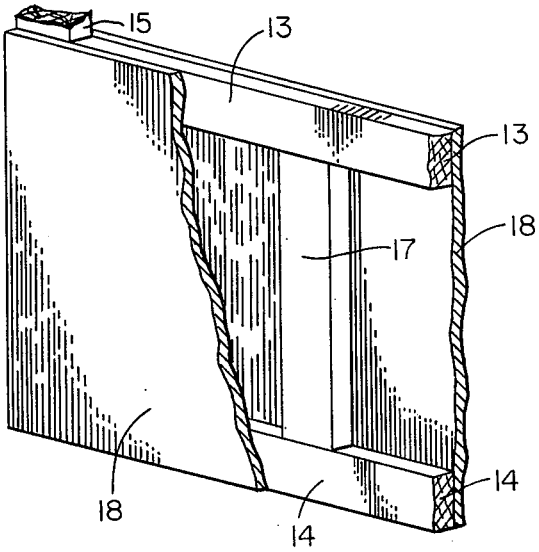
FIG. 3 is a partial isometric view of a second embodiment constructed in accordance with the present invention showing a box beam floor truss with one plywood web partially broken away.

A second embodiment of the invention includes a double web or box beam floor truss system illustrated in FIG. 3. In this embodiment vertical intermediate stiffeners 17 extend between and are connected to the top and bottom floor chords, with plywood webs 18 or other structural sheet material nailed and glued on each side of the stiffener-chord configuration thereby developing an efficient section modulus to resist bending and to provide a rigid joint for the floor to wall connection. A single web beam floor system is an alternate design that can be used.

Figure 4:
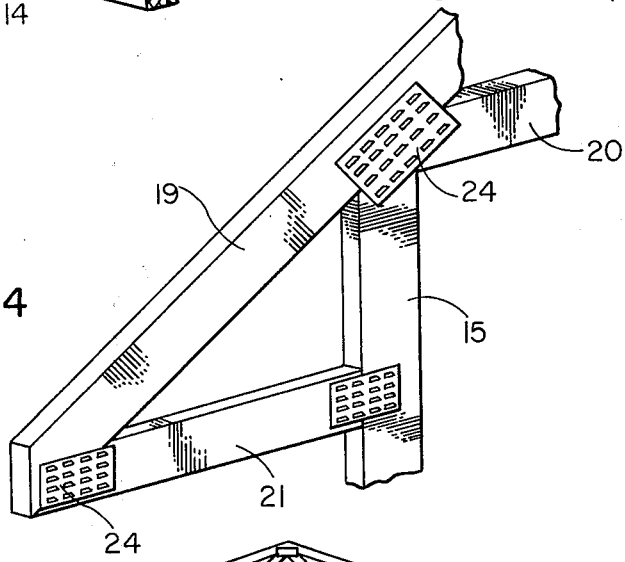
FIG. 4 is a partial isometric view showing the interconnections of a wall stud, top and bottom roof chords, and a lookout.

FIG. 1 shows that the ends of the foor truss system 12 are connected to the wall studs 15, here with two-point joints formed by the intersection of the top and bottom floor chords with the studs, thus transmitting loading forces between the floor truss system and the wall studs. The studs extend upward from the floor truss system, here from the bottom floor chord 14, to the joints between the top 19 and bottom 20 roof chords. In the illustrated frame, each of the wall studs is connected to the roof chords at this joint and is also connected at another point, approximately 6 to 18 inches lower, to a lookout or soffit member 21 which extends between the stud 15 and the overhanging ends of the top roof chord 19 parallel to the bottom roof chord 20. This three-point joint shown in FIG. 4 formed by the joint between the top 19 and bottom 20 roof chords and the end of the stud 15, the intersection of the lookout 21 and the stud 15, and the intersection of the top roof chord 19 and the lookout 21, forms a rigid joint which resists rotation, reduces the unsupported length of the stud, and transmits forces between the roof truss system and the wall stud.

The roof truss system 22 extends between and is connected to the upper ends of the studs 15. The system illustrated in FIG. 1 includes a bottom roof chord which extends between the ends of the studs and is parallel to the floor chords, and two top roof chords which connect together at an angle and extend over the point where they intersect the ends of the bottom roof chord and the top ends of the studs, thus forming an overhang. Also shown are web member 23 which extend between and connect to the top and bottom roof chords. These web members may be of any conventional truss type configuration such as a Fink Truss (depicted in FIGS. 1 and 5), a Howe Truss, or a Pratt Truss. Other roof truss systems may also be used but the uniqueness of the invention is a rigid framework provided by integrally joining roof and floor trusses together with studs, not in the actual truss design used.

The long chord members in both the roof and floor systems which may exceed the normal length of available lumber can be mechanically spliced without decreasing the strength of the frame. This splicing is done using metal truss plates, gusset plates, or with structural finger joints. The wall studs must be one piece but since the length requirement is not excessive there is no problem.

Ordinarily the joints in the frame systems are secured using conventional metal truss plates 24 but plywood gusset plates, or any rigid fasteners capable of transmitting moment, shear, and axial forces between the members may be used. These rigid joints distribute loading forces throughout the entire frame and thus minimize the reaction at any one point. The roof and floor systems are structurally tied together by the wall studs which transmit forces between the systems. Stability in the direction normal or perpendicular to the frames is provided by the diaphragm action of the roof and floor sheathing, and also by the shear resistance afforded by exterior wall sheathing 25, shown in FIG. 5.

These frame systems can be easily constructed by truss manufacturers. Individual wood members of the frame are first mass cut to the required dimensions. These members are then positioned into a flat fit up jig or template where truss plates or other means of rigid attachment are pressed into the joints. If either a single web beam or box beam is used for the floor system, the intermediate stiffeners may be toenailed to the floor chords before the plywood sheet(s) is (are) glued and nailed into place. The completed frames are then shipped to the construction site.

Figure 5:
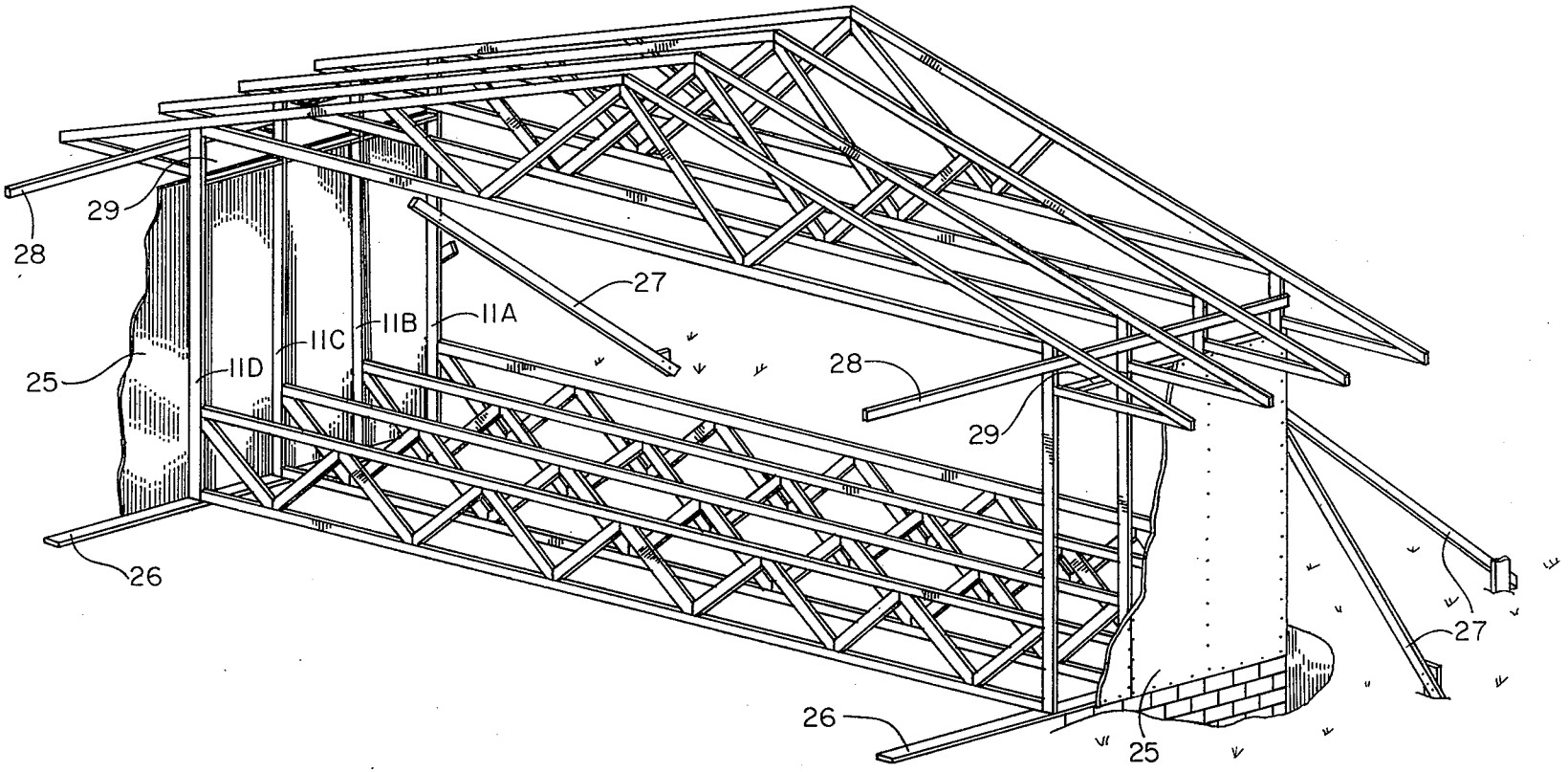
FIG. 5 is a partial isometric view of a building structure in the process of being erected.

At the site the preassembled frames are erected using tilt-up construction techniques. FIG. 5 shows sill plates 26 which are set on the prepared foundation and secured with anchor bolts as in conventional construction. The first frame 11A is then tilted up onto the sill plates 26 so that it is in a vertical plane which is normal to that of the sill plates and is connected to the plates by conventional means such as toenailing. This first frame is temporarily supported in an upright position, as by staked frame supports 27. A second frame 11B is then erected and connected in the same manner so that it is in a plane which is parallel to that of the first frame. The spacing between frames will be controlled by design loads and desired span or house width. The spacing should be some increment of the size of standard panel products. For example, 32-inch or 48-inch center would be compatible with standard 96-inch-long panel products such as plywood, gypsum board, or insulation board.

After the second frame is erected, some means running perpendicular to the frames and parallel to the sill plates, here lumber straps 28, must be installed to securely anchor the frames in proper vertical orientation and to aid in alinement. The lumber straps 28 are secured above each lookout 21 (depicted in FIG. 5) or on the top sides of the bottom floor chords, and can remain in place permanently and perform in a manner similar to cross bridging in conventional floor joist construction. These lumber straps are not necessary, however, since structural sheathing 25, also mounted perpendicular to the plane of the frames, can be applied directly as the frames are erected, thus securely anchoring the frames in proper vertical orientation. The bottom edge of the exterior wall sheathing 25 is nailed directly into the sill plates 26 thus providing a positive tie between the frames and the sill. Additionally, tiedown straps or anchor bolts (not depicted) can be used to secure the frames to the foundation. Blocking 29 may be installed between frames at the top edge of the sheathing for perimeter nailing. The blocking pieces can be precut to proper length, i.e., center-to-center distance of frames minus one stud thickness, and will facilitate erection.

The remainer of the frames 11C, D, etc. are erected in like manner and are secured to the sill plates, the lumber straps and the sheathing. The temporary supports 27 for the first frame are removed and the house is completed using conventional construction techniques.

It will thus be seen that the objects of the invention are fully accomplished in that there is provided a truss framing system that better resists exerted forces and is capable of supporting loads over long spans without intermediate support. The invention provides for quicker onsite construction without the need for high degree layout and construction detail skills with a building being constructed more quickly, using fewer raw materials and thus less expensively than when conventional methods are used.

It is understood by the inventor that the scope of this invention is not limited by the specific forms described, but that different configurations may be used. The invention may be embodied in other specific forms without departing from the spirit or essential characteristics thereof. The present embodiments are therefore to be considered in all respects as illustrative and not restrictive.

Having thus disclosed my invention, I claim:

1. A building, comprising a plurality of sill plates installed on a foundation, a plurality of frames disposed in parallel vertical planes normal to the plane of said sill plates, each frame comprising a floor truss system, wall studs connected to the ends of said system and extending upward therefrom, and a roof truss extending between and connected to the upper ends of said studs, said floor truss system, comprising a top floor chord and bottom floor chord, parallel with one another, which extend between and connect at their ends to said studs, with said bottom floor chord being adjacent to said studs' lower ends, with web members extending between and connected to said chords, means connecting said frames to said sill plates, means securely anchoring said frames in proper vertical orientation, said last-mentioned means running perpendicular to said frames.

2. The invention set forth in claim 1 wherein each of said studs extends upward from said bottom floor chord to one of the joints between the top roof chords and bottom roof chord, with said stud being connected to said joint and connected at a lower point to a lookout which extends between said stud and the overhanging end of said top roof chord.

3. The invention set forth in claim 2 wherein said roof truss system comprises a bottom roof chord extending between ends of said studs, being parallel to the floor chords, with angularly interconnected top roof chords, and web members extending between and connected to said top and bottom roof chords, with all connections being secured by rigid fasteners.

4. The invention set forth in claim 1 wherein intermediate stiffeners extend between and connect to the top floor chord and bottom flood chord, and wherein the web members are attached to each side of the stiffener-chord configuration.

5. A flat structural building frame to be used as a vertical component of a framing system, comprised of a floor system, wall studs connected to the ends of said system and extending upward therefrom, a roof truss system a roof truss system extending between the connected to the upper ends of said studs, and wherein said floor truss system comprises a top floor chord and a cottom floor chord, parallel with one another, which extend between and connect at their ends to said studs, with said bottom floor chord being adjacent to said studs' lower ends, with web members extending between and connected to said chords.

6. The invention set forth in claim 5 wherein each of said studs extends upward from said bottom floor chord to one of the joints between the top roof chords and bottom roof chord, with said stud being connected to said joint and connected at a lower point to a lookout which extends between said stud and the overhanging end of said top roof chord.

7. The invention set forth in claim 6 wherein said roof truss system comprises a bottom roof chord extending between the ends of said studs, being parallel to the floor chords, with angularly interconnected top roof chords, and web members extending between and connected to said top and bottom roof chords, with all connections being secured by rigid fasteners.

* * * * *